US005406800A

United States Patent [19]

Bonaquist

[11] Patent Number: 5,406,800

[45] Date of Patent: Apr. 18, 1995

[54] CRYOGENIC RECTIFICATION SYSTEM CAPACITY CONTROL METHOD

[75] Inventor: Dante P. Bonaquist, Grand Island, N.Y.

[73] Assignee: Praxair Technology, Inc., Danbury, Conn.

[21] Appl. No.: 250,240

[22] Filed: May 27, 1994

[51] Int. Cl.[6] ..... F25J 3/00

[52] U.S. Cl. ..... 62/21; 62/22; 62/24; 62/37

[58] Field of Search ..... 62/21, 24, 37, 22; 364/501

[56] References Cited

U.S. PATENT DOCUMENTS

| | | | |
|---|---|---|---|
| 3,912,476 | 10/1975 | Mikawa et al. | 62/37 |
| 4,566,887 | 1/1986 | Openshaw | 62/21 |
| 4,732,595 | 3/1988 | Yoshino | 62/11 |
| 5,084,081 | 1/1992 | Rohde | 62/22 |
| 5,129,932 | 7/1992 | Agrawal et al. | 62/22 |
| 5,148,680 | 9/1992 | Dray | 62/24 |
| 5,224,336 | 7/1993 | Agrawal et al. | 62/37 |
| 5,265,429 | 11/1993 | Dray | 62/41 |
| 5,351,492 | 10/1994 | Agrawal et al. | 62/24 |

*Primary Examiner*—Ronald C. Capossela
*Attorney, Agent, or Firm*—Stanley Ktorides

[57] ABSTRACT

A method for operating a cryogenic rectification plant wherein a column sump and/or top condenser liquid setpoint is changed in response to a feed flowrate change to control the operation of the plant to avoid product purity excursions without need for additional storage or holding tankage.

12 Claims, 2 Drawing Sheets

CRYOGENIC RECTIFICATION SYSTEM CAPACITY CONTROL METHOD

TECHNICAL FIELD

This invention relates generally to cryogenic rectification and more particularly to the efficient operation of a cryogenic rectification system upon a Achange in capacity, i.e. a change in the requirements of at least one product stream.

BACKGROUND ART

In the practice of cryogenic rectification a feed stream, such as feed air, is passed into a cryogenic rectification plant, such as a double column plant, for separation. One or more product streams are withdrawn from the cryogenic rectification plant and recovered. The feed stream flowrate is set to enable production of product at the desired demand rate.

During the course of operation of the cryogenic rectification plant the demand rate for one or more products may change. This necessitates a change in the capacity of the plant wherein the feed flowrate is changed. Unless specific control action is taken to prevent it, a change in the feed flowrate will cause a temporary change in the liquid to vapor (L/V) ratio within one or more of the columns until the system can return to equilibrium or steady state performance. The temporary L/V change is due to a disparity between the manner in which the feed flowrate change alters the vapor rate (V) within the columns compared to how the liquid rate (L) within the columns is altered. This change in the L/V ratio is undesirable because it adversely affects product purity. Accordingly, it is desirable to maintain the L/V ratio at the desired ratio during and after a change in the feed flowrate.

The cryogenic rectification industry has addressed this issue by providing cryogenic rectification plants with liquid storage or holding tanks to change the capacity of a cryogenic rectification plant in a controlled manner by providing liquid to and/or receiving liquid from a column to adjust the L/V ratio within the column. Such systems are effective but entail high capital costs for the tanks and the attendant piping.

Accordingly, it is an object of this invention to provide a method for changing the capacity of a cryogenic rectification plant in a controlled manner without the need for storage or holding tanks to adjust the L/V ratio of a column.

SUMMARY OF THE INVENTION

The above and other objects, which will become apparent to one skilled in the art upon a reading of this disclosure, are attained by the present invention, one aspect of which is:

A method for changing the capacity of a cryogenic rectification plant comprising:

(a) passing feed at a first flowrate into the higher pressure column of a cryogenic rectification plant comprising said higher pressure column and a lower pressure column;

(b) passing liquid from the sump of the higher pressure column into the lower pressure column;

(c) maintaining the liquid in the sump of the higher pressure column at a desired level by means of a sump level controller having a setpoint set at the desired level;

(d) changing the feed flowrate to be at a second flowrate; and (e) in response to the change in the feed flowrate, changing the setpoint of the sump level controller.

Another aspect of the invention comprises:

A method for changing the capacity of a cryogenic air separation plant comprising:

(a) passing feed air at a first flowrate into the higher pressure column of a cryogenic air separation plant comprising said higher pressure column, a lower pressure column, and an argon column having a top condenser;

(b) passing liquid from the sump of the higher pressure column into the top condenser and from the top condenser into the lower pressure column, and passing fluid out from the lower pressure column into the argon column;

(c) maintaining the liquid in the top condenser at a desired level by means of a top condenser level controller having a setpoint set at the desired level;

(d) changing the feed air flowrate to be at a second flowrate; and (e) in response to the change in the feed air flowrate, changing the setpoint of the top condenser level controller.

As used herein, the term "feed air" means a mixture comprising primarily nitrogen, oxygen and argon, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation or fractionation column or zone, i.e., a contacting column or zone wherein liquid and vapor phases as countercurrently contacted to effect separation of a fluid mixture, as for example, by contacting or the vapor and liquid phases on a series of vertically spaced trays or plates mounted within the column and/or on packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed.

As used herein the term "top condenser" means a heat exchange device which generates column downflow liquid from column top vapor.

As used herein the term "sump" means the bottom portion of a distillation column below the trays or packing elements in which liquid is accumulated. The liquid may be withdrawn as a product stream or transferred to another column.

As used herein the term "level controller" means a mechanical, pneumatic or electronic device or a mathematical algorithm programmed in a computer used for feedback control of the liquid level within a storage volume such as a tank or a column sump.

As used herein the term "setpoint" means the desired or target value for a dependent process variable (process output) under feedback control which is input to the controller either manually, or by another controller or mathematical algorithm programmed in a computer.

As used therein the term "feedback control" means control of a dependent process variable (process output) at or about a setpoint by adjusting one or more independent process variables (process inputs) based on the deviation of the process variable from its setpoint.

DETAILED DESCRIPTION

Figure 1:
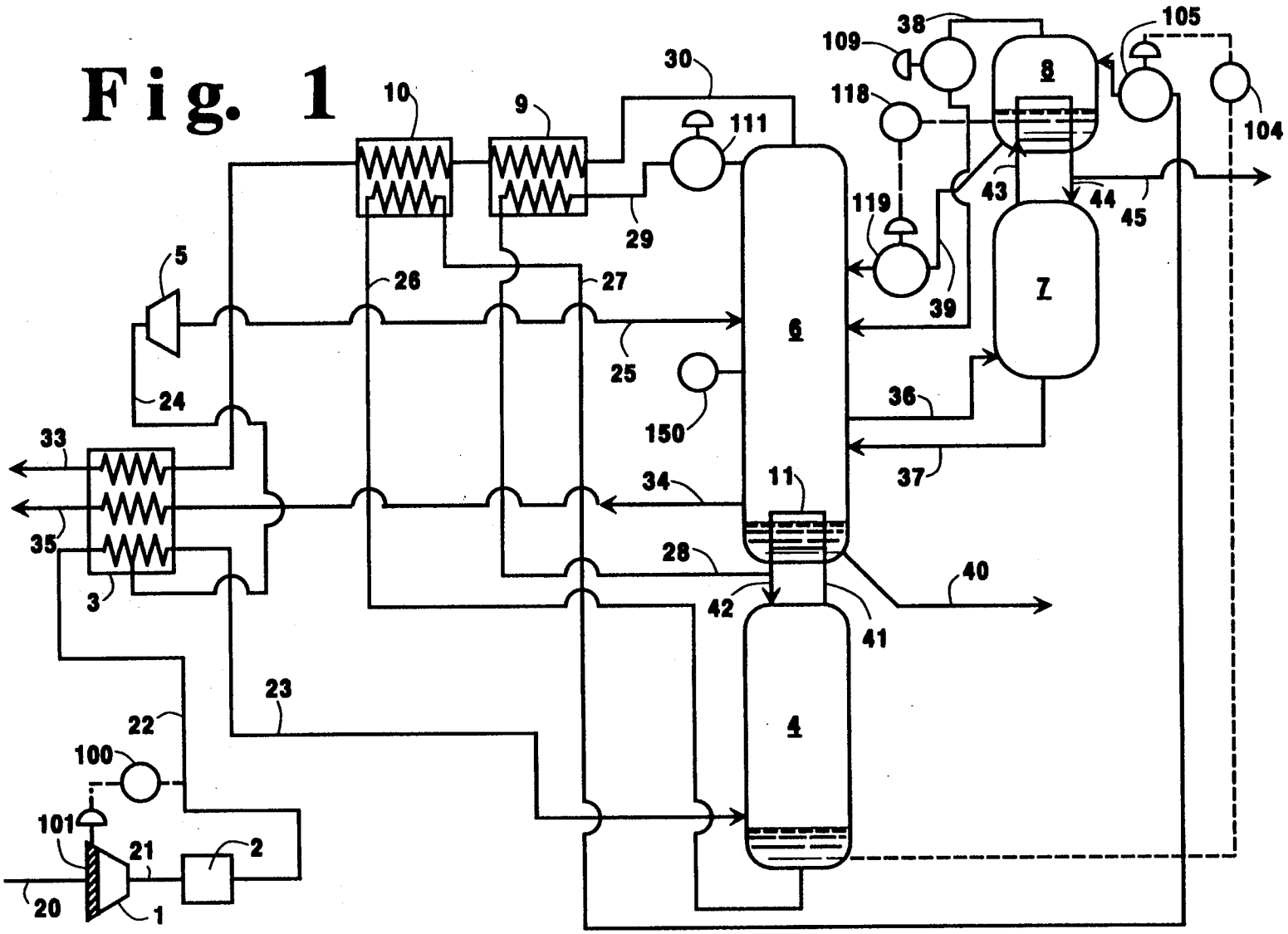
FIG. 1 is a schematic representation of a cryogenic rectification plant comprising a double column with an argon column which may be used in the practice of the invention.

The capacity control of double column cryogenic rectification plants, particularly those equipped with a side arm column to recover argon, is made difficult because of the hydraulic lag associated with the flow of liquid within the higher pressure column. An increase in feed flow entering the bottom of the higher pressure column is immediately reflected by an increase in vapor rising throughout the column. This is because the pressure change accompanying the flow change is very slight, so there is no lag due to the accumulation or depletion of vapor stored within the column. The presence of the additional vapor at the top of the higher pressure column results in an immediate increase in the main condenser boilup and the vapor rising throughout the lower pressure column for the same reason given above. The pressure change within the lower pressure column accompanying the flow change is also very small. However, the additional vapor condensed at the top of the higher pressure column to form liquid reflux which descends through the column takes some time to make its way from the top of the higher pressure column to the bottom and through the circuit connecting the bottom of the higher pressure column with the middle portion of the lower pressure column. This circuit may also involve the top condenser of the argon column. Because of this hydraulic delay, the L/V ratio within the lower pressure column undergoes a transient or deviation during a capacity change that will result in undesirable changes in product purity. Further, the main condenser liquid levels falls in response to the additional boilup which is not yet compensated for by additional liquid descending in the lower pressure column. To operate safely and efficiently, the main condenser liquid level must remain in a relatively narrow band. An excessively high level reduces heat transfer efficiency. A level which is too low requires the shutdown of the unit because of the possibility of boiling to dryness within the main condenser which is considered an unsafe operating practice. The opposite effects occur when feed flow entering the bottom the higher pressure column is reduced.

The invention addresses and solves these problems without the need for incorporating additional tankage into the cryogenic rectification system. The invention manipulates the setpoint of level controllers associated with the control of liquid level within the sump of the higher pressure column and/or the argon column top condenser. The level setpoints are decreased when feed flow entering the bottom of the higher pressure column is increased thereby providing additional liquid to the middle portion of the low pressure column immediately in order to mitigate the effect of the higher pressure column hydraulic delay. The additional liquid serves to compensate for the L/V transient in the lower pressure column during the capacity change and provides the additional liquid necessary to maintain the main condenser liquid level. This eliminates the need for any additional (usually expensive) tanks and associated controls and piping since the sump and argon column top condenser are normal components of a cryogenic rectification plant.

The invention preferably also employs the use of an internal fluid composition reading to make adjustments to the controller or controllers rather than waiting to check the composition of product before making such adjustments. In this preferred embodiment the invention makes use of an intermediate compositional variable (either direct composition analysis or inferential analysis based on temperature or differential temperature) located in the middle portion of the lower pressure column below the liquid feed point and, when an argon column is used, above the location where the argon column is connected. It has been found that this variable responds faster than other compositional variables usually measured and used in the feedback portion of the control systems. The use of this variable permits larger and faster capacity changes to be made by providing an indication of the L/V ratio within the middle portion of the low pressure column. The fast response allows the feedback system to correct for any variations in L/V that might lead to an undesirable change in product purities before the change in product purity can actually be measured.

The invention will be discussed in greater detail with reference to the drawings. FIG. 1 illustrates an air separation plant employing a double column and an argon column. Referring now to FIG. 1, feed such as feed air 20, at a flowrate generally within the range of from 200,000 to 12,000,000 standard cubic feet per hour (SCFH), is compressed by passage through compressor 1, generally to a pressure within the range of from 70 to 250 pounds per square inch absolute (psia). Compressed feed air stream 21 is then passed through purifier 2 for the removal of high boiling impurities such as carbon dioxide and water vapor, and resulting stream 22 is passed to main heat exchanger 3. Controller 100 measures and controls the flowrate of feed air stream 22 by manipulating compressor guidevanes 101 to keep the measured air flow rate of stream 22 at a desired setpoint.

Feed air is cooled by passage through main heat exchanger 3. A portion 24, generally comprising from 3 to 20 percent of the total feed air passed into the cryogenic air separation plant, is withdrawn after partial traverse from main heat exchanger 3, turboexpanded by passage through turboexpander 5 to generate refrigeration, and passed as stream 25 into column 6 which is the lower pressure column of a double column system which includes higher pressure column 4. The major portion of the feed air is passed in stream 23 from main heat exchanger 3 into higher pressure column 4 which is operating at a pressure generally within the range of from 65 to 245 psia.

Within higher pressure column 4 the feed air is separated by cryogenic rectification into nitrogen-enriched vapor and oxygen-enriched liquid. Nitrogen-enriched vapor is passed in stream 41 into main condenser 11 wherein it is condensed by indirect heat exchange with column 6 bottom liquid. Resulting nitrogen-enriched liquid is passed in stream 42 into column 4 for reflux. A portion 28 of the resulting nitrogen-enriched liquid is subcooled by passage through heat exchanger 9 and resulting stream 29 is throttled through valve 111 into lower pressure column 6 which is operating at a pressure less than that of higher pressure column 4 and generally within the range of from 16 to 60 psia.

Liquid from the sump of higher pressure column 4 is passed into lower pressure column 6. In the embodiment illustrated in FIG. 1, liquid from the sump of higher pressure column 4 passes through top condenser 8 prior to passing into lower pressure column 6. Oxygen-enriched liquid is passed in stream 26 out from the sump of column 4 and is subcooled by passage through heat exchanger 10. Resulting stream 27 is then passed through valve 105 and into top condenser 8. Sump level controller 104 maintains the liquid in the sump of column 4 at the desired level defined by a setpoint set for this level by adjusting valve 105.

Within top condenser 8 the oxygen-enriched liquid is partially vaporized against condensing argon column top vapor. Resulting oxygen-enriched vapor is passed from top condenser 8 through valve 109 in stream 38 and into lower pressure column 6. Remaining oxygen-enriched liquid is passed from top condenser 8 through valve 119 and into lower pressure column 6. Top condenser level controller 118 maintains the liquid in the top condenser at the desired level defined by a setpoint set for this level by adjusting valve 119.

Within lower pressure column 6 the various feeds are separated by cryogenic rectification into nitrogen-rich and oxygen-rich fluids. Nitrogen-rich vapor is withdrawn from column 6 in stream 30, warmed by passage through heat exchangers 9, 10 and 3 and withdrawn as stream 33. All or part of stream 33 may be recovered as product nitrogen, generally having a purity of up to 98 mole percent or more. Oxygen-rich vapor is withdrawn from column 6 in stream 34, warmed by passage through heat exchanger 3 and withdrawn as stream 35. All or part of stream 35 may be recovered as product oxygen, generally having a purity within the range of from 99 to 99.9 mole percent. Oxygen product may also be recovered as liquid in addition to or in lieu of vapor product recovery in stream 35 by withdrawing oxygen-rich liquid from column 6 in stream 40, all or part of which may be recovered as product oxygen generally having a purity within the range of from 99 to 99.9 mole percent. In the case where there is no argon column used, such as the embodiment illustrated in FIG. 2, the oxygen purity will generally be within the range of from 90 to 99.9 mole percent.

A fluid comprising primarily oxygen and argon is passed out from column 6 in stream 36 and passed into argon column 7 wherein it is separated by cryogenic rectification into argon-richer vapor and oxygen-richer liquid. Oxygen-richer liquid is passed from argon column 7 into lower pressure column 6 in stream 37. Argon-richer vapor is passed in stream 43 into top condenser 8 wherein it is condensed against the aforedescribed partially vaporizing oxygen-enriched liquid. Resulting argon-richer liquid is passed into argon column 7 in stream 44 as reflux. A portion 45 of the argon-richer liquid may be recovered as product having an argon concentration generally within the range of from 95 to 99.9 mole percent or more.

Figure 2:
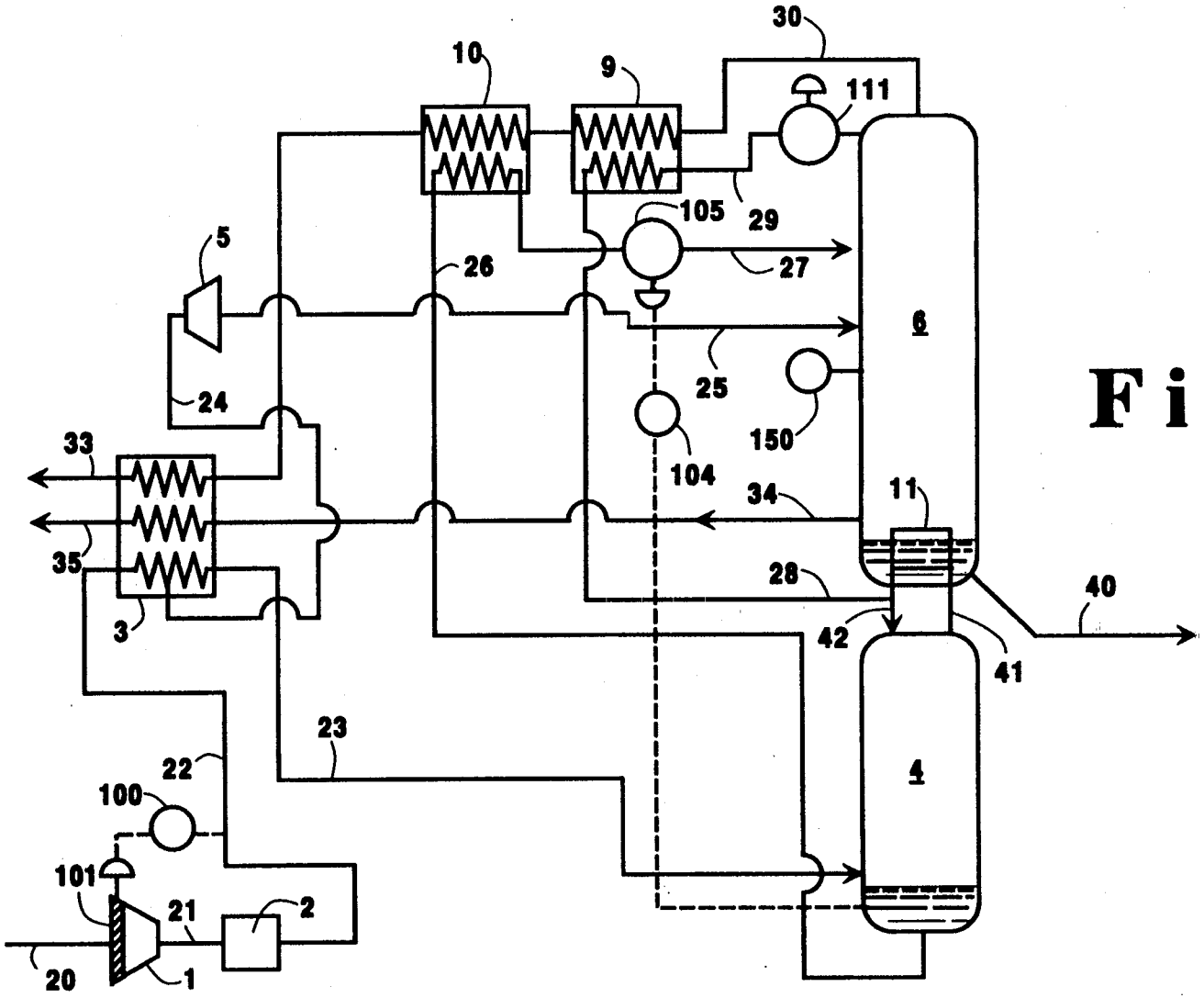
FIG. 2 is a schematic representation of a cryogenic rectification plant comprising a double column without an argon column which may be used in the practice of the invention.

FIG. 2 illustrates a double column cryogenic rectification plant without an argon column. For purposes of this disclosure, except as noted above, the operation of the double column plant illustrated in FIG. 2 is similar to that illustrated in FIG. 1 and thus will not be described again in detail. The numerals in FIG. 2 correspond to those of FIG. 1 for the common elements. In the embodiment illustrated in FIG. 2, liquid stream 27 from the sump of higher pressure column 4 is passed through valve 105 directly into lower pressure column 6 without passing through the argon column top condenser.

During the operation of the cryogenic rectification plant there may arise a need to change the capacity of the plant, i.e. to increase or decrease the flowrate of one or more of the product streams. Such a change may require a change in the feed flowrate. In the practice of this invention, in response to a change in the feed flowrate the setpoint of the sump level controller and/or the top condenser level controller is changed. When the feed flowrate is changed to a second flowrate which exceeds that of the first flowrate, the setpoint of the sump level controller and/or the top condenser level controller is changed to be at a lower level. This quickly increases the flow of liquid into the lower pressure column from the sump of the higher pressure column and serves to keep the L/V ratio in the lower pressure column stable despite the increased vapor flow resulting from the increased feed flow. When the feed flowrate is changed to a second flowrate which is less than the first flowrate, the setpoint of the sump level controller and/or the top condenser level controller is changed to be at a higher level. This quickly decreases the flow of liquid into the lower pressure column from the sump of the higher pressure column and serves to keep the L/V ratio in the lower pressure column stable despite the decreased vapor flow resulting from the decreased feed flow. The stable L/V ratio ensures that product purity is maintained at the desired level.

In a preferred embodiment of the invention the composition of fluid, either liquid or vapor, internal to the lower pressure column is determined and this intermediate composition determination is used to make minor adjustments to the sump level controller and/or the top condenser level controller. The fluid whose composition is determined is fluid from within the lower pressure column below the point where liquid from the sump of the higher pressure column is passed into the lower pressure column. If an argon column is used, this point is also above the point from where the fluid for passage into the argon column is passed out of the lower pressure column. This is illustrated in FIGS. 1 and 2 by composition sensor 150 which measures the composition, e.g. the oxygen or nitrogen fraction, of a liquid or vapor sample withdrawn from the lower pressure column. Alternatively a temperature sensor may be used in place of the composition sensor to sense the fluid temperature from which the composition of the fluid may be determined by inference.

Applicant has found that a determination of the composition of this fluid enables quicker adjustment of the L/V ratio than a determination of the composition of a product stream, without sacrificing accuracy. This is because the intermediate composition is more sensitive to L/V ratio changes and generally responds faster to these changes, particularly when oxygen purity is at or above 98 percent. The L/V ratio itself cannot be measured directly without significant and costly modification to the design of the lower pressure column. Further, the value of the intermediate composition is easily correlated with the composition of the oxygen product streams at steady state.

When the nitrogen mole fraction of the intermediate composition is rising above a given setpoint known to provide product oxygen of a certain purity, the L/V ratio in the lower portion of the lower pressure column is too high and must be decreased to prevent oxygen product purity from falling. Similarly when the nitrogen mole fraction of the intermediate composition is falling below a given setpoint known to provide product oxygen of a certain purity, the L/V ratio in the lower portion of the lower pressure column is too low and must be increased to prevent oxygen purity from rising. The change in L/V required to return the intermediate composition to its setpoint can be accomplished by adjusting the setpoints of level controllers 104 and 118 as well as other process flowrates such as those of streams 35, 29 and 36. Methods for adjusting the flowrates of such streams are well known. The adjustments to the setpoints of the level controllers can be accomplished by a feedback loop which uses a controller to adjust all the setpoints of level controllers 104 and 118 to maintain the measured intermediate composition at a desired specified setpoint. Alternatively, the same feedback loop can be used to prevent the intermediate composition from rising or falling without attempting to maintain it at any particular setpoint, by adjusting the setpoint of level controllers 104 and 118.

A preferred method for adjusting the level controller setpoints is to incorporate the measurement of the intermediate composition in a multivariable controller which considers the measurement of product oxygen, nitrogen and argon and column feed compositions, and is capable of adjusting the setpoints of level controllers 104 and 118 as well as the flowrate of streams 35, 29 and 36.

Now by the practice of this invention one may change the capacity of a cryogenic rectification plant while controlling the operation of the plant to reduce or eliminate product purity excursions without the need for an additional storage or holding tankage system. Although the invention has been described in detail with reference to certain preferred embodiments, those skilled in the art will recognize that there are other embodiments of the invention within the spirit and the scope of the claims.

I claim:

1. A method for changing the capacity of a cryogenic rectification plant comprising:

(A) passing fluid at a first flowrate into the higher pressure column of a cryogenic rectification plant comprising said higher pressure column and a lower pressure column;

(B) passing liquid from the sump of the higher pressure column into the lower pressure column;

(C) maintaining the liquid in the sump of the higher pressure column at a desired level by means of a sump level controller having a setpoint set at the desired level;

(D) changing the feed flowrate to be at a second flowrate; and (E) in response to the change in the feed flowrate, changing the setpoint of the sump level controller.

2. The method of claim 1 wherein the second feed flowrate exceeds the first feed flowrate and the setpoint of the sump level controller is changed to be a lower level.

3. The method of claim 1 wherein the second feed flowrate is less than the first feed flowrate and the setpoint of the sump level controller is changed to be at a higher level.

4. The method of claim 1 further comprising determining the composition of fluid within the lower pressure column at a point below the point where the liquid from the sump of the higher pressure column is passed into the lower pressure column, and adjusting the set point of the sump level controller based on this determination.

5. A method for changing the capacity of a cryogenic air separation plant comprising:

(A) passing feed air at a first flowrate into the higher pressure column of a cryogenic air separation plant comprising said higher pressure column, a lower pressure column, and an argon column having a top condenser;

(B) passing liquid from the sump of the higher pressure column into the top condenser and from the top condenser into the lower pressure column, and passing fluid out from the lower pressure column into the argon column;

(C) maintaining the liquid in the top condenser at a desired level by means of a top condenser level controller having a setpoint set at the desired level;

(D) changing the feed air flowrate to be at a second flowrate; and (E) in response to the change in the feed air flowrate, changing the setpoint of the top condenser level controller.

6. The method of claim 5 wherein the second feed air flowrate exceeds the first feed air flowrate and the setpoint of the top condenser level controller is changed to be at a lower level.

7. The method of claim 5 wherein the second feed air flowrate is less than the first feed air flowrate and the setpoint of the top condenser level controller is changed to be at a higher level.

8. The method of claim 5 further comprising determining the composition of fluid within the lower pressure column at a point below the point where liquid from the top condenser is passed into the lower pressure column and above the point where fluid is passed out from the lower pressure column for passage into the argon column, and adjusting the setpoint of the top condenser level controller based on this determination.

9. The method of claim 8 wherein liquid in the sump of the higher pressure column is maintained at a desired level by means of a sump level controller having a setpoint set at the desired level, further comprising adjusting the setpoint of the sump level controller based on the said determination of the fluid composition.

10. The method of claim 5 wherein liquid in the sump of the higher pressure column is maintained at a desired level by means of a sump level controller having a setpoint set at the desired level, further comprising changing the setpoint of the sump level control in response to the change in the feed air flowrate.

11. The method of claim 10 wherein the second feed air flowrate exceeds the first feed air flowrate and the setpoint of the sump level controller is changed to be at a lower level.

12. The method of claim 10 wherein the second feed air flowrate is less than the first feed air flowrate and the setpoint of the sump level controller is changed to be at a higher level.

* * * * *

UNITED STATES PATENT AND TRADEMARK OFFICE

CERTIFICATE OF CORRECTION

PATENT NO. : 5,406,800

DATED : April 18, 1995

INVENTOR(S) : D.P. Bonaquist

It is certified that error appears in the above-identified patent and that said Letters Patent is hereby corrected as shown below:

In column 1, line 9 delete "Achange" and insert therefor --change--.

In column 2, line 36 delete "as" and insert therefor --are--.

In column 2, line 38 delete "or" and insert therefor --of--.

In claim 10, line 5 delete "control" and insert therefor --controller--.

Signed and Sealed this

Eighteenth Day of July, 1995

Bruce Lehman

*Attest:*

BRUCE LEHMAN

*Attesting Officer*

*Commissioner of Patents and Trademarks*